United States Patent [19]

Utsumi et al.

[11] Patent Number: 5,016,828

[45] Date of Patent: May 21, 1991

[54] SHREDDING MACHINE

[75] Inventors: Tatsuya Utsumi, Yamatokouriyama; Shinji Kawamura, Sakurai, both of Japan; Tetsuya Itoh, Hamburg, Fed. Rep. of Germany; Hiroshi Moriyama, Yamatokouriyama; Naofumi Okada, Tenri, both of Japan

[73] Assignee: Sharp Kabushiki Kaisha, Osaka, Japan

[21] Appl. No.: 390,000

[22] Filed: Aug. 7, 1989

[30] Foreign Application Priority Data

| | | | |
|---|---|---|---|
| Aug. 12, 1988 | [JP] | Japan | 63-202353 |
| Aug. 12, 1988 | [JP] | Japan | 63-202354 |
| Aug. 12, 1988 | [JP] | Japan | 63-202356 |
| Aug. 12, 1988 | [JP] | Japan | 63-202358 |

[51] Int. Cl.[5] ..... B02C 18/08

[52] U.S. Cl. ..... 241/158; 241/236; 241/241; 241/242; 241/293

[58] Field of Search ..... 241/236, 158, 100, 260.1, 241/242, 239, 241, 293

[56] References Cited

U.S. PATENT DOCUMENTS

| | | | |
|---|---|---|---|
| 385,342 | 7/1888 | Creager | 241/158 X |
| 1,302,398 | 4/1919 | Mangini | 241/241 X |
| 1,756,450 | 4/1930 | Black | 241/293 x |
| 2,985,211 | 5/1961 | Letz | 241/242 X |
| 3,620,461 | 11/1971 | Pelleschi . | |
| 3,682,402 | 8/1972 | Goldhammer . | |
| 4,018,392 | 4/1977 | Wagner . | |
| 4,062,500 | 12/1977 | Peterson, Jr. . | |
| 4,124,169 | 11/1978 | Hatanaka . | |
| 4,192,467 | 3/1980 | Hatanaka . | |
| 4,231,530 | 11/1980 | Haranaka . | |
| 4,261,523 | 4/1981 | LaPointe . | |
| 4,619,407 | 10/1986 | Goldhammer . | |
| 4,821,967 | 4/1989 | Moriyama . | |

FOREIGN PATENT DOCUMENTS

| | | | |
|---|---|---|---|
| 0244850 | 11/1987 | European Pat. Off. . | |
| 2214800 | 9/1973 | Fed. Rep. of Germany . | |
| 2644703 | 4/1978 | Fed. Rep. of Germany | 241/242 |
| 2731247 | 11/1978 | Fed. Rep. of Germany . | |
| 2045280 | 1/1980 | Fed. Rep. of Germany . | |
| 2214799 | 3/1984 | Fed. Rep. of Germany . | |
| 3434177 | 3/1986 | Fed. Rep. of Germany . | |
| 45585 | 11/1976 | Japan . | |
| 516769 | 6/1977 | U.S.S.R. | 241/242 |
| 1171797 | 11/1969 | United Kingdom . | |
| 1568745 | 6/1980 | United Kingdom . | |
| 2176173 | 12/1986 | United Kingdom . | |

*Primary Examiner*—Mark Rosenbaum

[57] ABSTRACT

A shredding machine has a rotary cutter and a fixed cutter. The rotary cutter includes a cutter part with a spiral cutting edge and a flute, and a column part for rotatably holding by a holding member for rotation of the rotary cutter. The fixed cutter has a cutting edge contacting with the cutter part of the rotary cutter. In rotating the rotary cutter, longitudinal slips of documents are fed between the cutters so that the documents enter the flute of the rotary cutter to cut the slips into chips by cooperation between the cutting edge of the rotary cutter and the cutting edge of the fixed cutter.

14 Claims, 10 Drawing Sheets

SHREDDING MACHINE

BACKGROUND OF THE INVENTION

The present invention generally relates to a cutting papers machine for cutting into pieces such as those documents to be discarded of or disposed and, more particularly, to a shredding machine.

There has been known a shredding mechanism provided with a pair of cutting rollers oppositely rotating with respect to each other, and a shredding mechanism provided with a rotary cutter and a fixed cutter combined with the rotary cutter. The latter is disclosed in, for example, Japanese Utility Model Publication No. 51-45585. According to the Japanese Utility Model, the mechanism includes the rotary cutter having spiral edges and the fixed cutter arranged to contact with the edges of the rotary cutter under pressure. The rotary cutter has plural spiral edges and is rotatably supported by bearings through column parts of which are formed at both ends of the rotary cutter and have the outer diameters smaller than the outer diameters of the edges thereof. The fixed cutter is supported by a supporting member to contact with the rotary cutter under pressure by a spring. The rotary cutter is so constructed that the column parts and a cutter part with the spiral edges are separately manufactured and then are assembled to each other to form one rotary cutter.

Since according to the conventional mechanism, the cutter part of the rotary cutter must be manufactured separately from the column parts as holding parts for rotatably holding the rotary cutter, it results in complicated construction and lower productivity. Since the cutter part is separated from the column parts, each section at which the cutter part is connected with each of the column parts often suffers some damage when applying any force to the section. The requirement of holding means for holding both ends of the column parts of the rotary cutter in the arrangement causes the holding means to become complicated in construction.

Furthermore, in the conventional machine, the papers transporting direction in which paper such as those documents to be discarded or disposed of are fed into the machine is not shown. The shredding capability of the mechanism depends on the direction of feed in a shredding machine with the mechanism constructed by a combination of between the fixed cutter and the rotary cutter. For example, when the papers are fed in the same direction as a direction in which the rotary cutter moves rotates, the direction for shredding the papers is the same as the direction for feeding the papers, thereby causing shredding capability to decrease or a shredding operation to be impossible.

Moreover, in the conventional shredding mechanism, the rotary cutter contacts with the fixed cutter under pressure and rotation of the rotary cutter causes sheets of the papers to cut into pieces. In this case, almost the same hardness of the cutters by a hardening process results in heat evolution by friction therebetween in rotation of the rotary cutter, occurrence of a metal sound by partial contact therebetween based on any error in manufacturing and assembling, and an insufficient shredding operation. For preventing these disadvantageous, various kinds of members including the cutters and the holding means for holding the cutters must be manufactured and assembled with high accuracy to result in higher manufacturing and assembling cost and very troublesome assemblage.

SUMMARY OF THE INVENTION

The present invention has been developed with a view to substantially solving the above described disadvantages and has for its essential object to provide an improved shredding machine which is simple in construction and higher in productivity, an may effectively prevent any damage.

Another object of the present invention is to provide an improved shredding machine of which the rotary cutter is readily manufactured and the holding means for rotatably holding both ends of the column part of the rotary cutter becomes simple in construction.

A further object of the present invention is to provide an improved shredding machine which may prevent decreasing shredding capability and causing shredding operations to become impossible.

A still further object of the present invention is to provide an improved shredding machine which may prevent heat evolution by friction between elements, occurrence of metal sound by partial contact therebetween based on any error in manufacturing and assembling, and insufficient shredding operation and which may become lower manufacturing and assembling costs and simplify assemblage.

In accomplishing these and other objects of the present invention, there is provided a shredding machine which comprises a rotary cutter including a cutter part with a spiral cutting edge and a column part with substantially the same outer diameter as that of the cutter part; a fixed cutter arranged to contact with the cutter part of the rotary cutter; and a rotary cutter holding means for rotatably holding at least the column part of the rotary cutter for rotation of the rotary cutter.

By the arrangement according to the present invention as described above, since a commercial drill for drilling may be used as the rotary cutter with the spiral cutting edge, the machine may be manufactured at low cost and since the cutter part and the column part of the drill are integrally formed, mechanical strength, the shredding capability, and shredding life thereof may be improved. Thus, the present invention may have higher productivity and effectively prevent any damage to parts thereof.

In another aspect of the present invention, the shredding machine further comprises a fixed cutter holding means for pivotably supporting one end of the fixed cutter; and a bias means for pressing the fixed cutter against the rotary cutter.

By the arrangement according to the present invention, since the column part is formed at only the one end of the rotary cutter and the rotary cutter is rotatably supported by the holding means so that the rotary cutter is cantilevered, the mechanism for rotatably holding the rotary cutter is simple in construction. Furthermore, since the rotary cutter is so constructed that the spiral cutting edge and flute are formed on the remaining part except for the column part thereof and it is not required to arrange a special member for holding the rotary cutter, the rotary cutter may be manufactured at a lower cost. Since the fixed cutter is pressed against the rotary cutter under pressure by the bias means, the whole cutting edge of the fixed cutter may contact with the rotary cutter under pressure to prevent partial contact therebetween even though the fixed cutter is cantilevered similar to the rotary cutter.

In a further aspect of the present invention, the shredding machine is so constructed that one face of the fixed cutter is positioned in a direction substantially perpendicularly intersecting a direction in which the rotary cutter moves, the machine further comprising a document transporting means for transporting documents to the one face of the fixed cutter.

By the arrangement according to the present invention, since the documents to be disposed or discarded may be transferred in the direction of increase of the shredding capability, the capability may be improved and prevent a shredding operation from becoming impossible. By regulating the document feeding direction with one face of the fixed cutter, the machine may not be required to arrange any special guide members thereby allowing the construction of the machine to become small and less expensive.

In a still further aspect of the present invention, the shredding machine is so constructed that the fixed cutter is softer than the rotary cutter, the machine further comprising a bias means for pressing the fixed cutter against the rotary cutter.

By the arrangement according to the present invention, since the fixed cutter is softer than the rotary cutter, the running-in between the rotary cutter and the fixed cutter may be easily performed without improvement of the accuracy of the rotary cutter and the fixed cutter in manufacturing and assembling, resulting in prevention of the occurrence of heat evolution and unusual sound. Furthermore, it may prevent for the rotary cutter from partially contacting with the fixed cutter, and thus prevent an entire cutting part of the rotary cutter partially contacting the fixed cutter to run in. It also may prevent documents from being insufficiently shredded at the same time.

BRIEF DESCRIPTION OF THE DRAWINGS

These and other objects and features of the present invention will become apparent from the following description taken in conjunction with preferred embodiments thereof with reference to the accompanying drawings, in which.

DETAILED DESCRIPTION OF THE PREFERRED EMBODIMENTS

Figure 1:
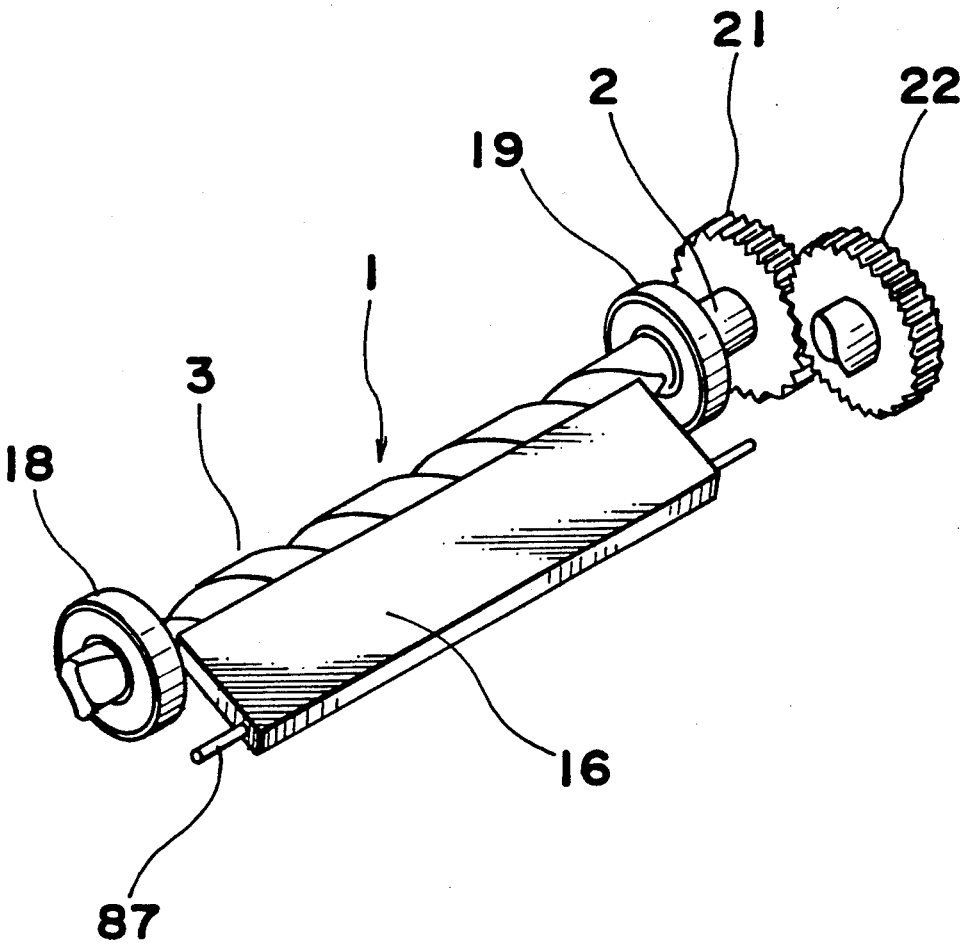
FIG. 1 is a perspective view showing a main part of a shredding mechanism of a shredding machine according to the first embodiment of the present invention.

Before the description of the present invention proceeds, it is to be noted that like parts are designated by like reference numerals throughout the several views of the accompanying drawings.

A shredding machine of the preferred embodiment according to the present invention comprises a rotary cutter having a spiral cutting edge and a fixed cutter having a cutting edge contacted with the edge of the rotary cutter to cut paper into pieces such as those documents to be discarded or disposed of.

The rotary cutter is so constructed that a flute or flutes are formed on the circumferential surface of a circular cylinder made of metal such as carbon steel or alloyed steel. At either one or both ends of each flute, the spiral cutting edge is formed. The optimum number of flutes depends on the outer diameter of the metal cylinder. That is, in a case where plenty of flutes are formed on the circumferential surface of the cylinder having the small outer diameter, it is possible to destroy the cylinder because of an insufficient strength thereof. Conversely, in a case where a few of the flutes are formed on the surface of the cylinder having the larger outer diameter, shredding efficiency is decreased. Therefore, the number of the flute is preferably 1 to 6, more preferably 2 to 4, in a case where the outer diameter of the metal cylinder is 8 to 40 mm. The rotary cutter comprises a cutter part where the flute is formed and a column part where no flute is formed. The depth of each flute is preferably ½ to ¼ of the outer diameter of the metal circular cylinder in a case where the number of the flutes is 2. If the depth of the flute is too large, it is possible to result in insufficient strength of the rotary cutter to destroy paper. Conversely, if the depth thereof is too small, it is difficult to insert elongated slips of documents in the flute to thereby decreasing the shredding efficiency. The flute is preferably formed in circular arc-like shape. As the rotary cutter is made of metal circular cylinder, the cutter part and the column part are integrally formed to increase mechanical strength and the outer diameters of the cutter part and the column part are substantially the same. A spiral angle between the rotary axis and the edge of the rotary cutter is preferably 5 to 50 degrees, more preferably 15 to 35 degrees.

Figure 2:
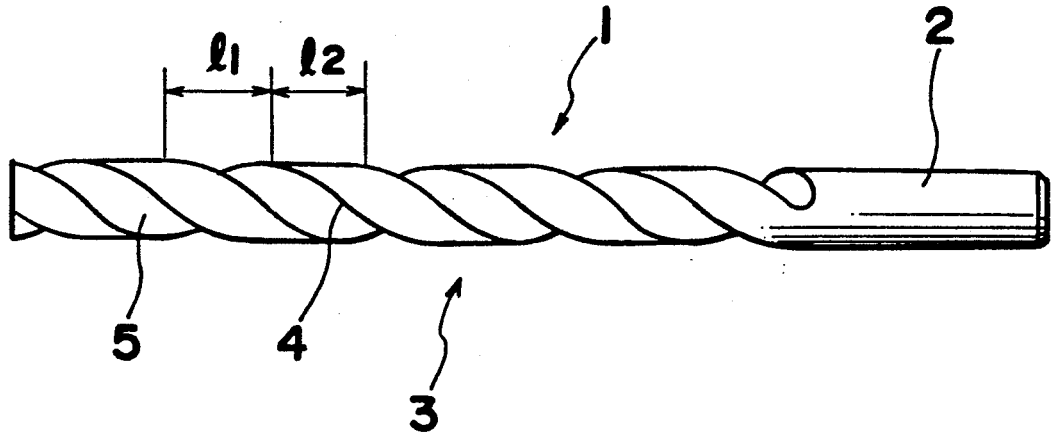
FIG. 2 is a front view of a rotary cutter of the shredding mechanism.

FIG. 2 shows a front view of a rotary cutter 1 according to the first embodiment. The rotary cutter 1 comprises a cutter part 3 having two spiral cutting edges 4, and the column part 2 hold by a bearing 19 described below to rotatably held the rotary cutter 1. The rotary cutter 1 is so constructed that the two spiral-flutes 5 are formed on the circumferential surface of the circular metal cylinder. The outer diameter of the column part 2 is substantially the same as that of the cutter part 3. Of the cutter part 3, the width $l_1$ of each flute and the distance $l_2$ between the flutes are dimensioned as follows. As the elongated slips of the documents inserted in the flutes 5 are shredded by cooperating with the fixed cutter, the width of the flute is preferably as large as is possible so that a number of documents may be inserted therein. Thus, a greater number of slips of the documents are inserted in the flutes to be cut into chips, resulting in an increase in shredding efficiency. Conversely, if the width of the flute 5 is too large, it causes the strength of the rotary cutter to decrease. Therefore, each of the flutes is so formed that a ratio $l_1/l_2$ of the flute width to the flute distance with respect to each of the flutes is from 0.8 to 3.0.

FIG. 1 shows a perspective view of a shredding part of a shredding mechanism employing the rotary cutter 1. The cutter part 3 and the column part 2 of the rotary cutter 1 are respectively inserted in holes of ball bearings 18 and 19 to fit, so that the rotary cutter 1 is rotatably supported thereby. On the column part 2, a driving gear 21 for transmitting rotating force, which is outputted from a driving motor, to the rotary cutter 1 is fixed. A fixed cutter 16 is arranged to contact with the rotary cutter 1.

According to the arrangement described above, in rotating the rotary cutter 1, elongated slips of documents to be shredded are fed in a space formed between the rotary cutter 1 and the fixed cutter 16. Parts of the documents enter the flutes 5 of the rotary cutter 1 before the documents are shredded by the spiral cutting edges of the rotary cutter 1 and the fixed cutter 16 to form chips.

Figure 3:
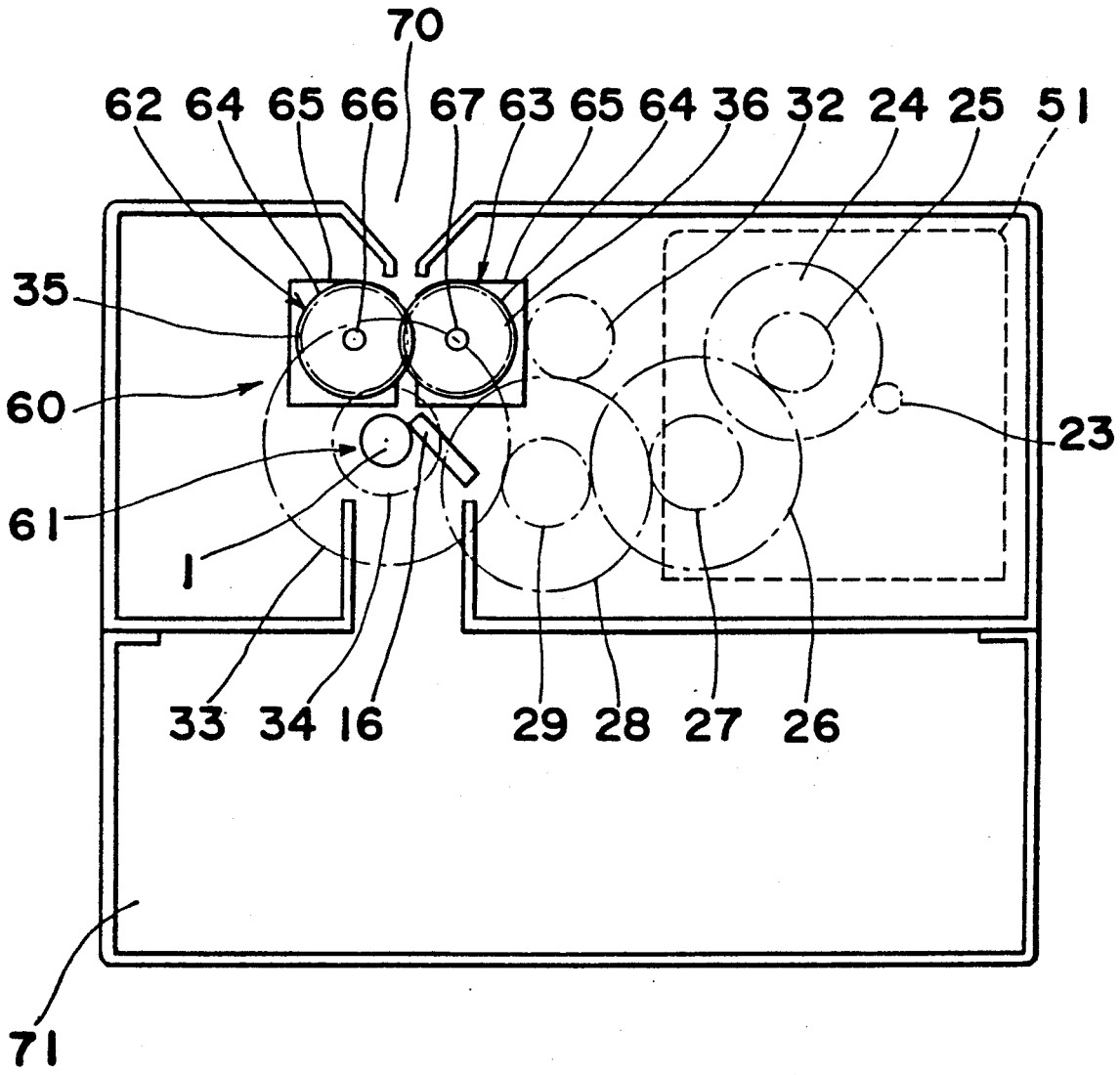
FIG. 3 is a sectional view of the machine.

FIG. 3 shows a sectional view of a shredding machine to which the shredding mechanism is applied. The machine 50 comprises a longitudinal cutter unit 60 and a transverse cutter unit 61. The documents fed in an opening 70 for inserting the documents are first cut to form longitudinal slips by the longitudinal cutter unit 60 and sequentially, the slips are cut to form chips by the transverse cutter unit 61 to discharge the chips to a chip accommodating unit 71. The longitudinal cutter unit 60 comprises a pair of cutter members 62 and 63 of which each is so constructed that a metal circular cutting edge 64 having the uneven circumferential surface and 1 to 3 mm thick, and a synthetic resin-made spacer 65 are alternately arranged on each of cylinder shafts 66 and 67. The spacers 65 each have an opening (not shown) for rotation of the shaft 66 or 67. Each edge 64 is fixed on each of the shafts 66 and 67 of the cutter members 62 and 63 at intervals of about 3 to 8 mm partitioning by the spacer 65 which is not fixed on each of the shafts 66 and 67 to allow the shafts 66 and 67 to rotate. Rotation of the shafts 66 and 67 causes each edge 64 to rotate with the shafts 66 and 67. Each confronting edge 64 of the cutter members 62 and 63 contacts with each other to rotate together to cut the documents into longitudinal pieces. The transverse cutter unit 61 comprises the rotary cutter 1 and the fixed cutter 16 as shown in FIG. 1. The rotation of the rotary cutter 1 and the edges 64 is driven by a driving motor 51. A rotating force transmitting system for transmitting rotating force to the rotary cutter 1 and the edge 64 is constructed by gears with such gear ratios that the peripheral speed of the rotary cutter 1 is faster than that of the edge 64. Assuming that the peripheral speed of the rotary cutter 1 is slower than that of the edge 64, longitudinal slips of the documents shredded by the longitudinal cutter unit 60 are bent between the longitudinal cutter unit 60 and the transverse cutter unit 61 . As a result, it is difficult for the slips to enter the flutes 5 of the rotary cutter 1 and then, to perform an efficient shredding operation. Concretely, the peripheral speed of the rotary cutter 1 is 50 to 200 mm/sec and the peripheral speed of the circular cutting edge 64 is 10 to 100 mm/sec. The motor 51 is driven while being controlled by a switch (not shown) disposed on an operation unit (not shown) or a paper detecting switch (not shown) disposed near the opening 70.

Figure 4:
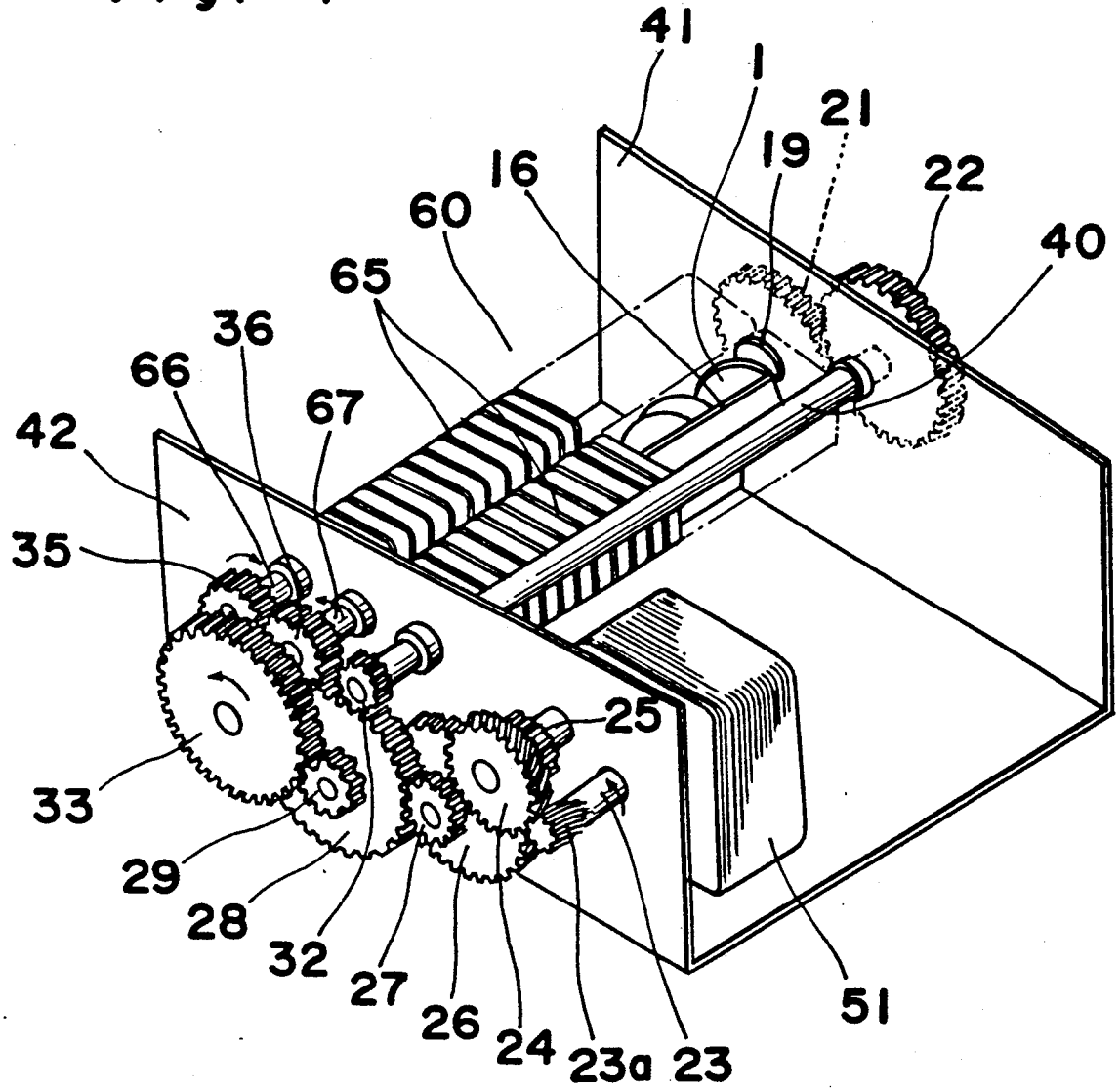
FIG. 4 is a perspective view of the machine.

FIG. 4 shows a perspective view of the appearance of the main part of the shredding machine. Driving of the motor 51 causes a rotary shaft 23 and a helical gear **23*a* fixed on one end of the shaft 23 to rotate. The helical gear 23*a* transmits the rotating force of the shaft 23 to a helical gear 24 engaged with the helical gear 23*a*. The helical gear 24 has a gear 25 fixed on the same shaft thereof. The rotating force is transmitted to a gear 26 through the gear 25. The gear 26 has a gear 27 fixed on the same shaft thereof. The rotating force transmitted to the gear 27 is transmitted to a gear 28 through the gear 27. A gear 29 fixed on the same shaft as that of the gear 28 transmits the rotating force to a gear 33 for driving the rotary cutter 1. A gear 34 fixed on the same shaft as that of the gear 33 engages with a gear 35 fixed on one end of the shaft 66 which is located at the left side of the cutter member 62 in FIG. 3. The gear 35 engages with a gear 36 fixed on one end of the shaft 67 which is located at the left side of the cutter member 63 in FIG. 3. The gears described above are rotatably supported by a frame 42. The shafts 66 and 67 are rotatably supported by a frame 41 and the frame 42** through bearings.

In the arrangement, the clockwise rotation of the driving motor 51 in FIG. 3 causes the edges 64 of the longitudinal cutter unit 60 to rotate in directions in which documents fed in the machine are inserted to be cut into slips.

On the other hand, the gear 28 engages with a gear 32 so that rotating force is transmitted to the rotary cutter 1 through a shaft 40 on which the gear 32 is fixed. The shaft 40 is rotatably supported by the frames 41 and 42. Then, a transmitting gear 22 is fixed to the opposite end of the shaft 40 to the one end thereof where the gear 32 is fixed. The transmitting gear 22 engages with the driving gear 21 fixed on the shaft of the rotary cutter 1, that is, the column part 2 of the rotary cutter 1. Therefore, the rotary cutter 1 rotates clockwise in FIG. 3 based on counterclockwise rotation of the driving motor 51.

Then, the rotating force for rotating the shaft 23 is transmitted to the edge 64 of the cutter member 62 through the gears 24, 25, 26, 27, 28, 29, 33, 34, 35, and 36, and to the rotary cutter 1 through the gear 32, the rotary shaft 40, and the gears 22 and 21, respectively. The bearings 18 and 19 for rotatably holding the rotary cutter 1 are respectively supported at the frames 42 and 41.

Figure 5:
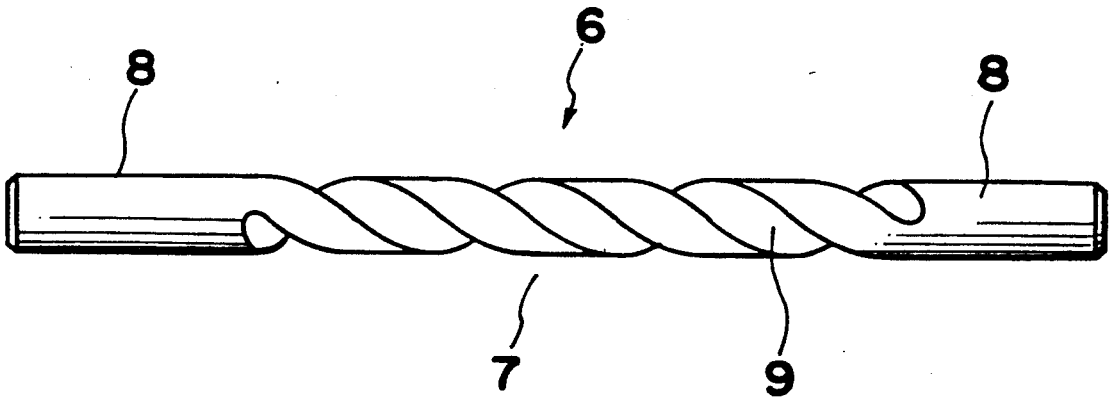
FIG. 5 is a front view of another rotary cutter of a shredding machine according to the first embodiment of the present invention.

FIG. 5 shows a front view of another rotary cutter 6 of the first embodiment. The rotary cutter 6 comprises a cutter part 7 having a spiral cutting edge and disposed at the middle thereof, and column parts 8 disposed at both the ends thereof. The rotary cutter 6 is made of metal circular cylinder having at least one spiral flute 9 formed on the circumferential surface thereof.

Figure 6:
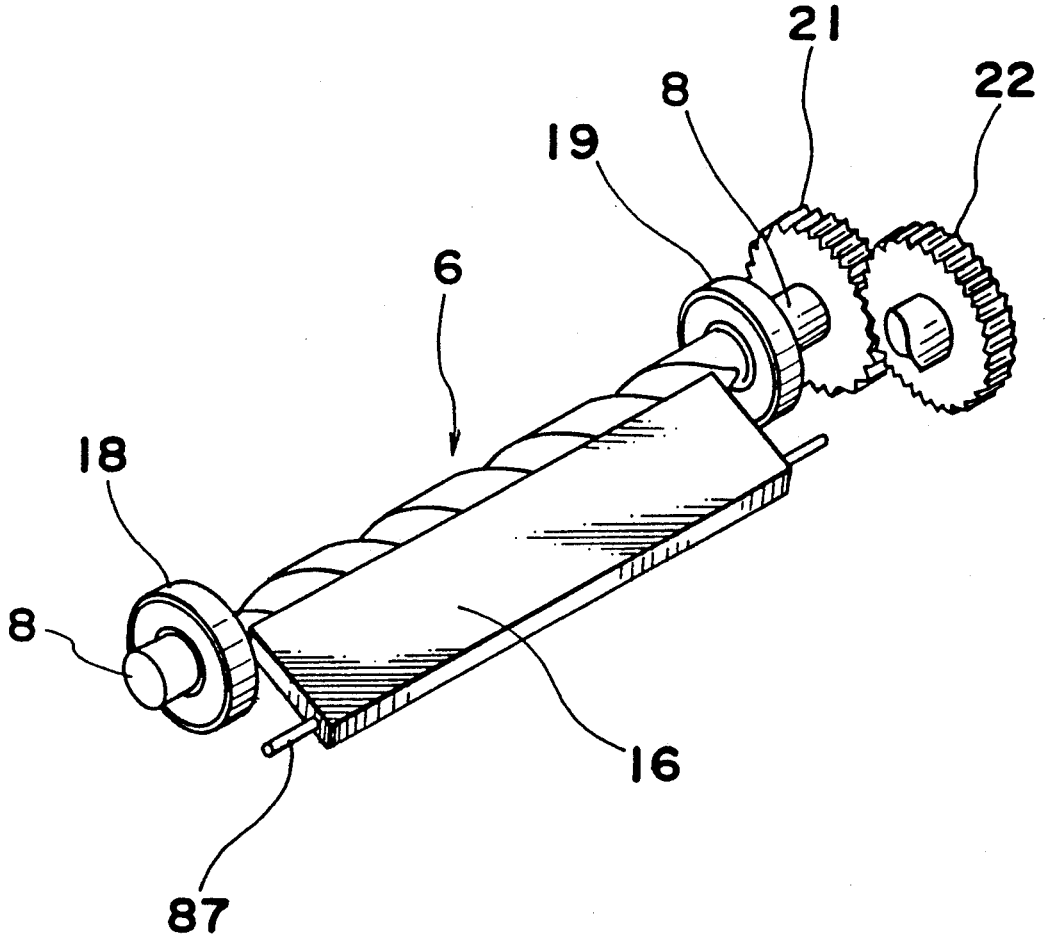
FIG. 6 is a perspective view of the shredding machine including the rotary cutter shown in FIG. 5.
Figure 8:
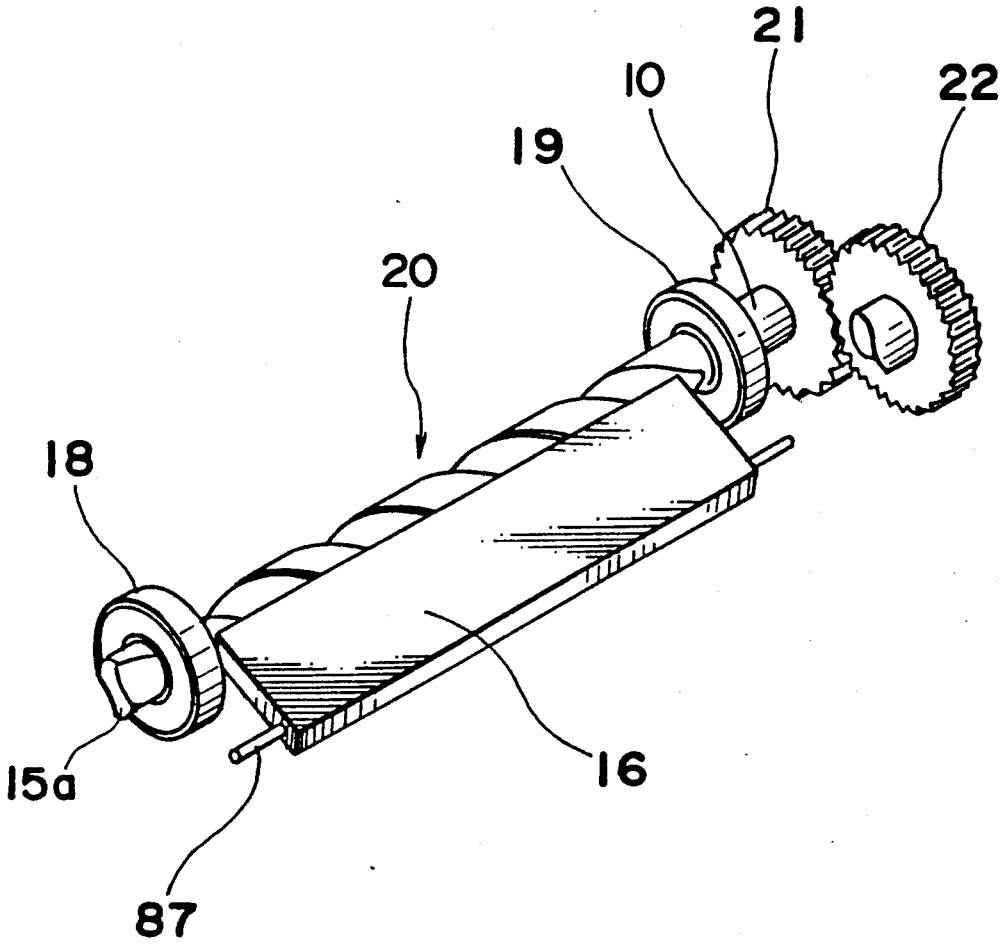
FIG. 8 is a perspective view of the shredding machine including the rotary cutter shown in FIG. 7.

FIG. 6 shows a shredding mechanism employing the rotary cutter 6. The rotary cutter 6 is so held that both ends of the column parts 8 thereof are rotatably supported by the bearings 18 and 19, respectively, similarly to the cutter 1 in FIG. 1. In the arrangement, since the rotary cutter 6 is rotatably supported by both ends of the column parts 8, it may be more certain that the rotary cutter 16 is rotatably supported.

Figure 7:
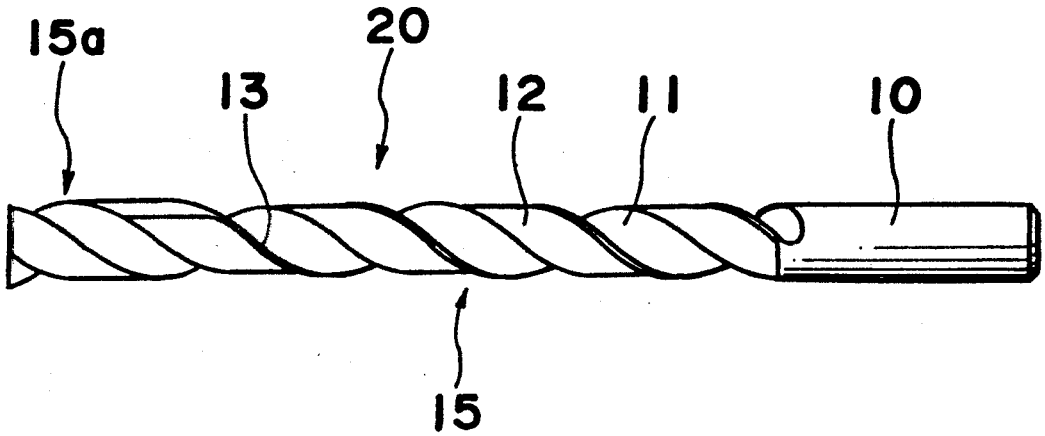
FIG. 7 is a front view of still another rotary cutter according to the first embodiment of the present invention.

FIG. 7 shows a front view of still another rotary cutter 20 of the first embodiment of the present invention. The rotary cutter 20 comprises a cutter part 15 having a spiral cutting edge 13, and a column part 10. At the side of the cutter part 15 which is closest the column part 10, a deep flute 11 and a shallow flute 12 with a width of about 0.5 to 3 mm which is parallel to and more shallow than the deep flute 11 are formed at a wide area thereof, respectively. The formation of the flutes 11 and 12 causes the contact area between the fixed cutter 16 and the rotary cutter 17 to decrease, resulting in large contact pressure between the edge 13 and the fixed cutter 16 in order to increase the shredding capability. A gap formed between the rotary cutter 20 and the fixed cutter 16 at the wider area of the rotary cutter 20 results in substantially less clogging of the chips between the cutters 20 and 16. At the distal end 15*a* of the cutter part 15 of the rotary cutter 20, no flute is formed. The reason is that an area contacting the rotary cutter 20 with the bearing 18 increases to more certainly hold the cutter 20.

According to the arrangement of the first embodiment, since a commercial drill for drilling may be used as the rotary cutter with the spiral cutting edge, the machine may be cheaper in construction, and since the cutter part and the column part of the drill are integrally formed, the mechanical strength, the shredding capability, and the shredding life thereof may be improved.

Figure 9:
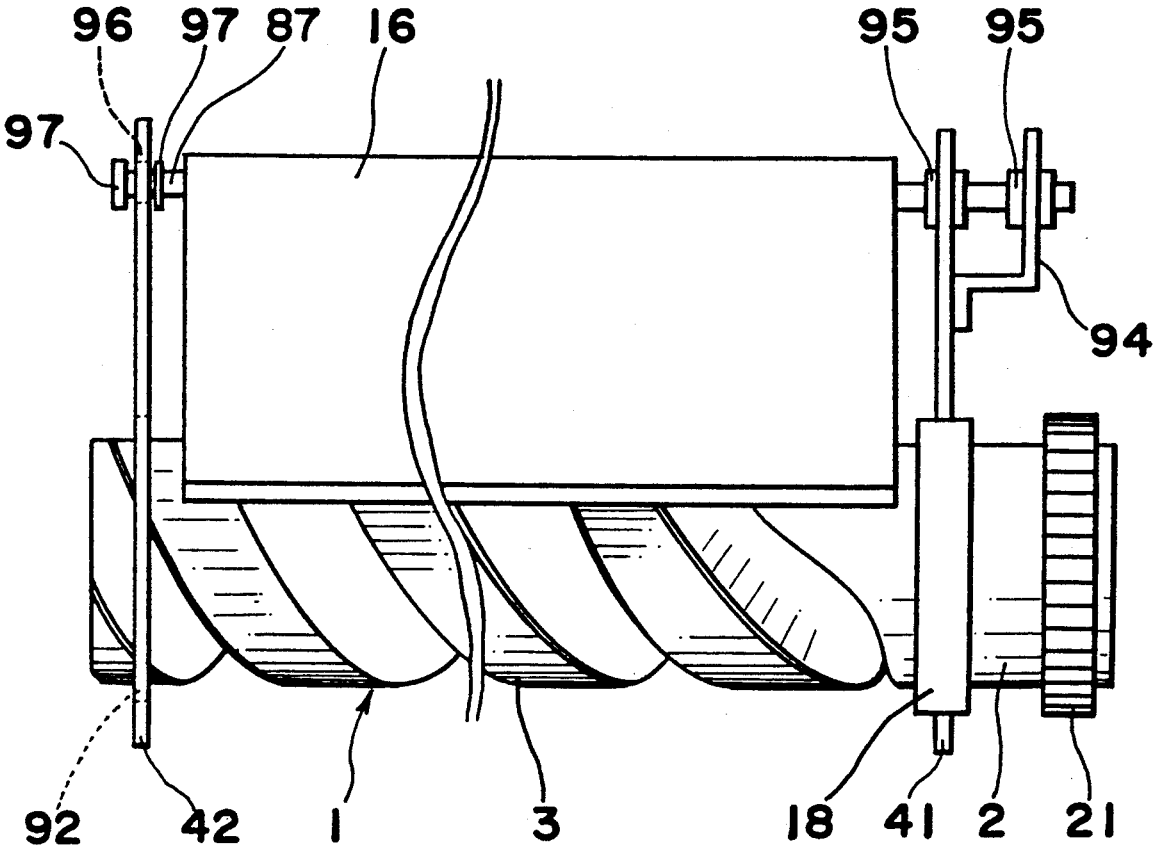
FIGS. 9 and 10 are a perspective view and a side view, respectively, showing a main part of a shredding machine according to the second embodiment of the present invention.
Figure 10:
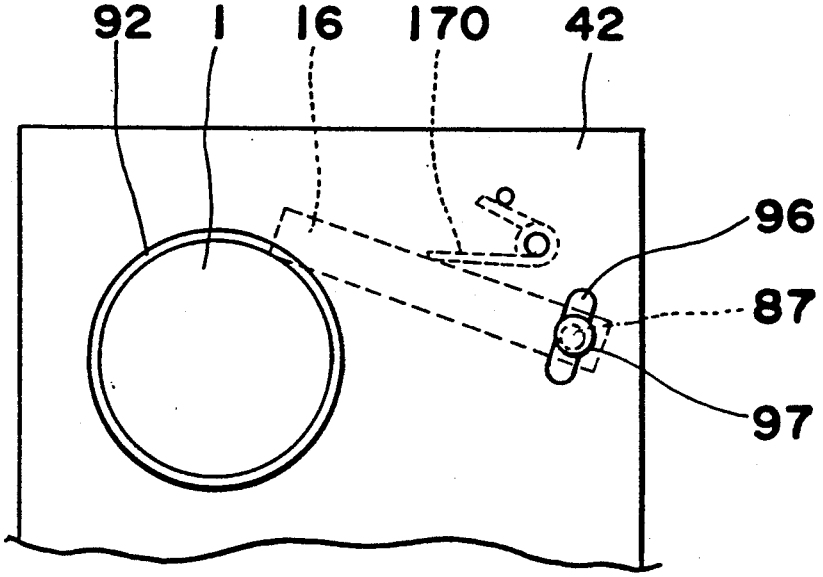

FIGS. 9 and 10 show a shredding machine 90 of the second embodiment according to the present invention. The rotary cutter 1 of the second embodiment similar to the rotary cutter 1 of the first embodiment also has the cutter part 3 and the column part 2. The one end of the column part 2 is inserted in the hole of the bearing 18 under pressure. The bearing 18 is attached to and rotatably supported by the frame 41 of the shredding machine. As shown in FIG. 9, the driving gear 21 for rotating the rotary cutter 1 is fixed on the one end of the column part 2 of the rotary cutter 1 to engage with the transmitting gear 22. The one end of the cutter part 3 thereof with the spiral cutting edge is inserted in an opening 92 formed at the frame 42 confronting with the frame 41 to be held therein. Then, the rotary cutter 1 is cantilevered and the one end of the cutter part 3 itself is directly supported by the frame 41.

On the other hand, both ends of a shaft 87 of the fixed cutter 16 is rotatably supported by the frames 41 and 42, respectively, and the fixed cutter 16 is pivotably supported by the shaft 87, so that the cutting edge of the fixed cutter 16 contacts with the cutting edge of the rotary cutter 1 under pressure by bias force of a bias means, that is, springs 170. The springs 170 are properly spaced along the longitudinal direction of the fixed cutter 16 thereabove in FIG. 9. Then, the fixed cutter 16 is properly contacted with the rotary cutter 1 by the bias force. As best shown in FIG. 9, the end corresponding to the column part 2 of the rotary cutter 1 of the shaft 87 of the fixed cutter 16 is rotatably supported by the frame 41 and an auxiliary member 94 of which one end is fixed to the frame 41, through rubbers 95, respectively. As shown in FIG. 10, the other end of the shaft 87 of the fixed cutter 16 is inserted in a long hole 96 formed on the frame 42 to be movably held therein. Reference numeral 97 is a stopper for preventing the other end of the shaft 87 from moving out of the hole 96.

The other arrangement such as material and configuration of the machine is the same as that of the first embodiment. The material of the rotary cutter 1 is the same kind as that of a drill for drilling. The shredding operation of the machine of the second embodiment is the same as that of the first embodiment.

According to the second embodiment, the bearing 18 is arranged at only the column part 2 formed at the one end of the rotary cutter 1 so that the column part 2 is rotatably supported by the frame 41, resulting in a very simple mechanism for rotatably holding the rotary cutter 1. Then, the construction of the rotary cutter 1 is the same as that of the conventional drill for drilling, that is, a spiral flute or spiral flutes and a spiral cutting edge or spiral cutting edges are formed on the circumferential surface of metal circular column without a holding element for rotatably holding the metal column. Only at one end of the metal column, the column part is formed, and thus, the spiral flute and the spiral cutting edge are easily formed on the metal column.

Furthermore, the one end of the fixed cutter 16 is cantilevered as well as the rotary cutter 1 and the other end thereof is movably, that is, pivotably supported by the shaft 87. Then, the fixed cutter 16 may contact with all parts of the rotary cutter 1 under pressure. Therefore, even if the cantilevered rotary cutter 1 has some backlash in assembling to the frames 41 and 42, since the fixed cutter 16 is pressed against the rotary cutter 1 by the bias force of the springs 170 so as to absorb the backlashes, the fixed cutter 1 may contact with the whole surface of the rotary cutter 1 without partial contact therebetween.

Figure 11:
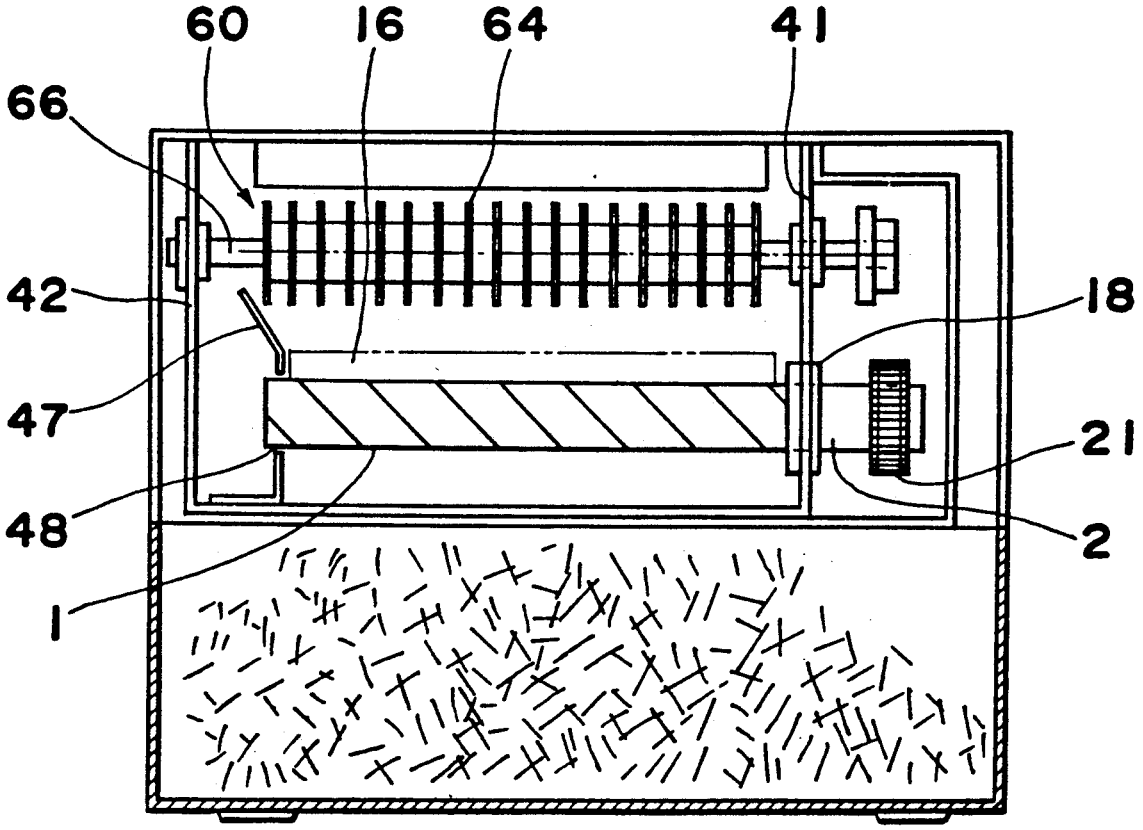
FIG. 11 is an explanatory view of a concrete example of the shredding machine of the second embodiment.

FIG. 11 shows a concrete example of another holding means for rotatably holding the cutter part of the rotary cutter 1. A guide plate 47 for guiding the slips shredded by the longitudinal cutter unit 60 to the transverse cutter unit 61 is arranged in the machine and has an opening 48. The cutter part is inserted in the opening 48 to be rotatably held thereby as shown in FIG. 11. In this case, the slips longitudinally cut by the longitudinal cutter unit 60 are guided by the guide plate 47 and are certainly transported to the rotary cutter 1 to be shredded.

According to the arrangement of the second embodiment, since the holding part, that is, the column part is formed at only the one end of the rotary cutter and the rotary cutter is rotatably supported by the bearings so that the rotary cutter is cantilevered, the mechanism for rotatably holding the rotary cutter is simple in construction. Furthermore, since the rotary cutter is so constructed that the spiral cutting edge and flute are formed on the remaining part except for the column part thereof and it is not required to arrange a special member for holding the rotary cutter, the rotary cutter may be manufactured at a low cost. Since the fixed cutter is pressed against the rotary cutter under pressure by the springs, the whole cutting edge of the fixed cutter may contact with the rotary cutter under pressure to prevent partial contact therebetween even though the fixed cutter is cantilevered similar to the rotary cutter.

Figure 12:
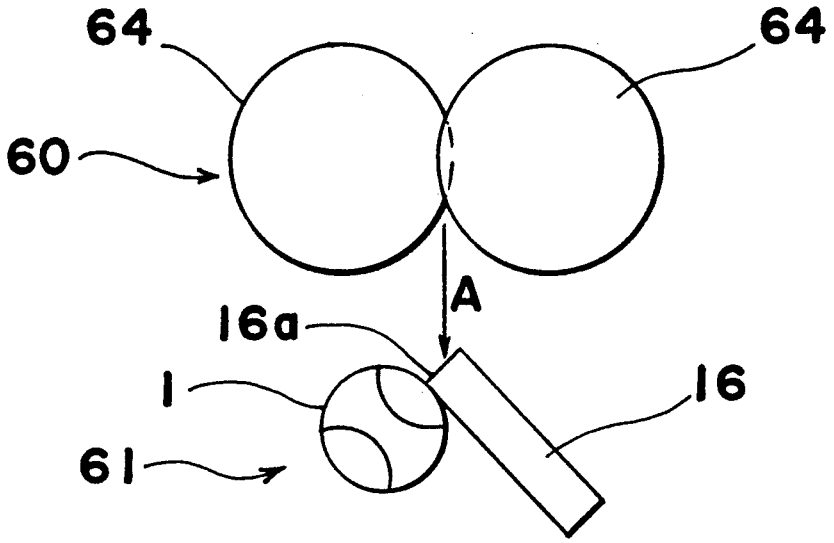
FIG. 12 is a schematic side view showing a main part of a shredding machine according to the third embodiment of the present invention.

FIG. 12 shows a schematic side view of a main part of a shredding machine according to the third embodiment. Below the edge 64 of the longitudinal cutter unit 60, the transverse cutter unit 61 comprising the rotary cutter 1 and the fixed cutter 16 is arranged. The longitudinal slips of the documents cut by the longitudinal cutter unit 60 are transferred in a direction shown in an arrow (A) to contact with one face 16*a* of the fixed cutter 16 so as to be guided towards the rotary cutter 1 by the one face 16a of the fixed cutter 16 which serves as a guide member. The fixed cutter 16 is so arranged that the one face 16a thereof is disposed along a direction intersecting generally perpendicularly to a direction in which the rotary cutter 1 moves at a portion where the rotary cutter 1 contacts with the fixed cutter 16. The reason is that since in shredding by the relative movement of cutting edges, it is better for shredding capability to feed documents in the direction intersecting generally perpendicularly to a relatively moving direction of a cutting edge as compared with another direction, it is preferable to feed the documents in the direction intersecting generally perpendicularly to the relatively moving direction of the rotary cutter 1.

Figure 13:
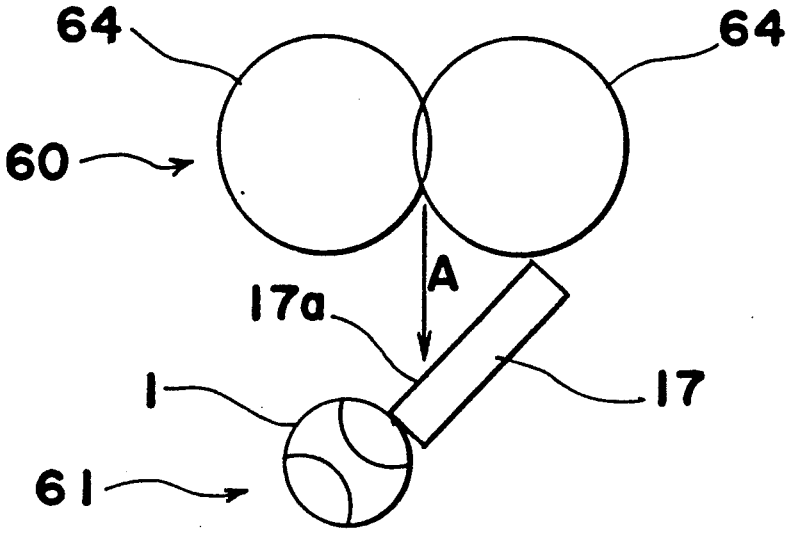
FIG. 13 is a schematic side view showing a main part of another shredding machine according to the third embodiment.

FIG. 13 shows a schematic side view of another shredding machine of the third embodiment according to the present invention. In this machine, a wider face 17a of a fixed cutter 17 serves as the guide member. The fixed cutter 17 is so arranged that the face 17a thereof is disposed in a direction intersecting perpendicularly to the moving direction of the rotary cutter 1.

According to the arrangements of the shredding machines described in FIGS. 12 and 13, the longitudinal slips of the documents cut by the longitudinal cutter unit 60 are transferred in the direction of increase of the shredding efficiency which intersects generally perpendicularly to the moving direction of the rotary cutter 1 while being guided by the face 17a of the fixed cutter 17, in order to cut into chips. In the embodiment, a guide member may be arranged in order to certainly transfer the documents, instead of the face 17a of the fixed cutter 17.

Figure 14:
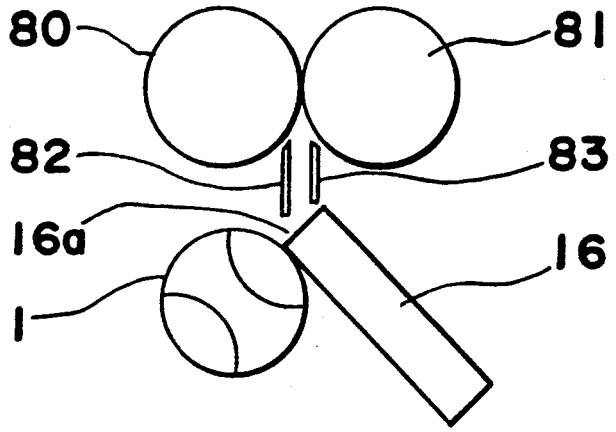
FIG. 14 is a schematic side view showing a main part of still another shredding machine according to the third embodiment.

FIG. 14 shows a schematic side view of still another shredding machine of the third embodiment according to the present invention, the machine consisting of only a shredding mechanism comprising the rotary cutter 1 and the fixed cutter 16. The documents are transferred towards the one face 16a of the fixed cutter 16 through a pair of rubber transfer rollers 80 and 81. Between the transfer rollers 80 and 81 and the fixed cutter 16, guide members 82 and 83 for guiding the documents towards the one face 16a of the fixed cutter 16 to certainly transfer them thereto are arranged.

The transfer means for feeding the documents between the rotary cutter 1 and the fixed cutter 16 may be replaced, if so desired, by a pair of transfer rollers, the longitudinal cutter unit, or a guide plate.

According to the description in the third embodiment, since the documents to be disposed or discarded may be transferred in the direction of increase of the shredding capability, the capability may be improved. By regulating the document feeding direction with the one face of the fixed cutter, the machines may not be required to arrange any special guide members and to cause the construction of the machine to become small and cheaper.

Figure 15:
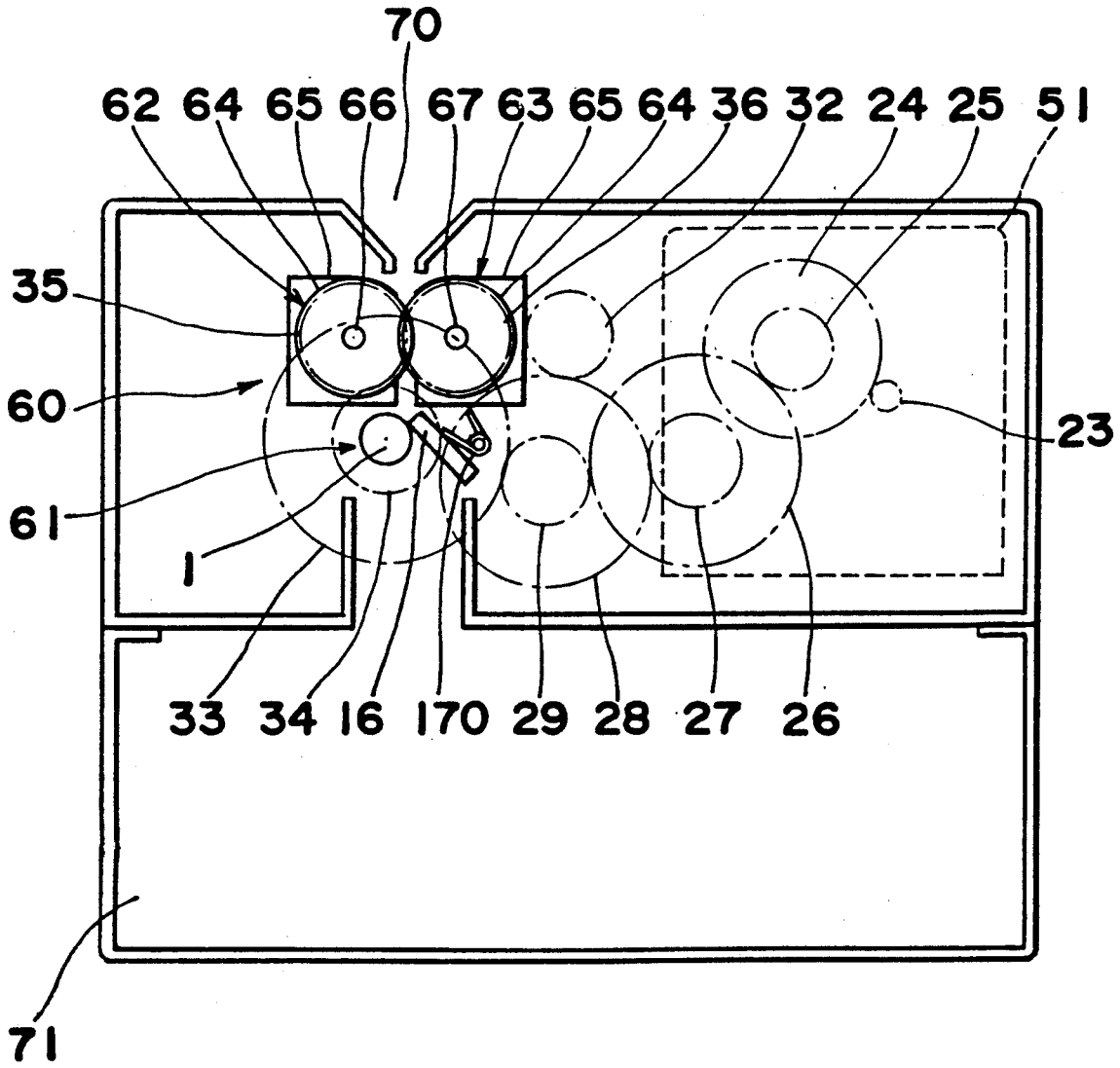
FIG. 15 is a sectional view of a shredding machine according to the fourth embodiment.

FIG. 15 shows a sectional view of a whole shredding machine 88 of the fourth embodiment according to the present invention.

The material of the rotary cutter 1 with the spiral cutting edges is the same kind of that as a commercial drill for drilling. For example, the rotary cutter 1 may be so constructed that a flute or flutes are formed on the circumferential surface of a circular cylinder made of metal such as carbon steel and alloyed steel. Here, the material of the rotary cutter 1 is referred to SKH51 in JIS (Japanese Industrial Standard) G 4403 and is hardened to an Rc of 60-65. The fixed cutter 16 is made of normal iron plate, which is referred to as SPCC in JIS G 3141, with a $R_B$ about 86 (Rc about 6) softer than that of the rotary cutter 1.

According to the arrangement described above, the accuracy of the fixed cutter 16 may be decreased in manufacturing and assembling as compared with that of the conventional fixed cutter. The reason that the conventional hardened fixed cutter is so constructed that the allowable positioning error between the fixed cutter and the cutting edge of a conventional rotary cutter is very small is that either error in manufacturing or assembling causes only parts of the fixed cutter to partially contact with the rotary cutter, resulting in prevention of smooth shredding operation or seizing by heat evolution. Furthermore, the problem of occurrence of unusual sound arises.

However, since the fixed cutter 16 is softer than the rotary cutter 1 in the shredding machine of the fourth embodiment, the distal end of the cutting edge of the fixed cutter 16 wears away by the rotary cutter 1 in initial contact between the fixed cutter 16 and the rotary cutter 1 so that the whole cutting edges of the fixed cutter 16 contact with the rotary cutter 1 for prevention of partial contact therebetween, even though the fixed cutter 16 has such an error that the fixed cutter in manufacturing and assembling is not within allowable value to result in partial contact therebetween in the conventional machine. This initial contact therebetween is called running-in. The running-in causes the contact pressure therebetween and the wearing speed of the fixed cutter to decrease and efficiently results in prevention of occurrence of such an unusual sound and heat evolution.

Figure 16:
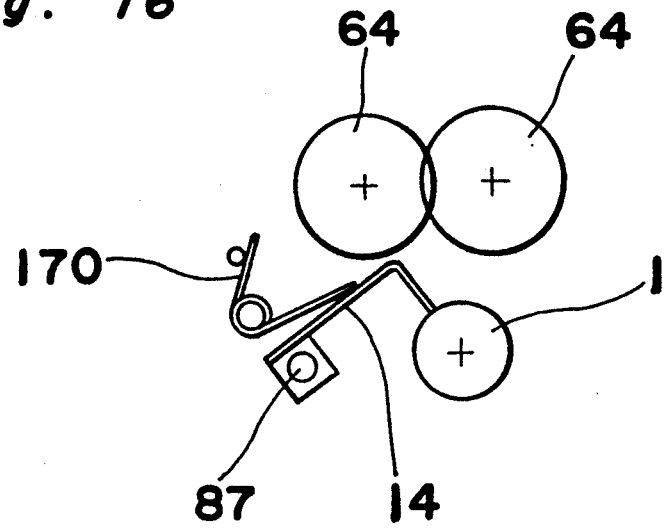
FIG. 16 is an explanatory view of a concrete example of a fixed cutter of the machine according to the fourth embodiment.

The fixed cutter 16 may have a construction other than the flat plate shown in FIG. 1. For example, as shown in FIG. 16, it may have such a construction that thin sheet metal is bent to serve as an edge face, the board thickness face of a fixed cutter 14 being formed along the board thickness direction thereof. Since the same board thickness face of the fixed cutter 14 always contacts with the rotary cutter 1 even though the distal end of the edges of the fixed cutter 14 which contacts with the rotary cutter 1 is worn away, the contacting face may keep a constant configuration to more stably maintain the shredding capability.

The fixed cutter 14 is fixed on one bent end of the shaft 87 supported between the frames 41 and 42 thereby. The fixed cutter 14 is made of phosphor bronze plate etc. so as to have elasticity itself to always contact with the rotary cutter 1 under pressure without the spring 170.

According to the arrangement of the fourth embodiment, the running-in between the rotary cutter 1 and the fixed cutter 16 or 14 may be easily performed without improvement of the accuracy of the rotary cutter 1 and the fixed cutter 16 in manufacturing and assembling, resulting in prevention of occurrence of heat evolution and unusual sound. Furthermore, it may be prevented for the rotary cutter 1 from partially contacting with the fixed cutter 16 or 14, and thus whole parts of the rotary cutter 1 partially contact with the fixed cutter 16 or 14 to run in. It also may be prevented for documents to be disposed from insufficiently shredding at the same time.

It should be noted that although the foregoing embodiments have been described in connection with the shredding machine comprising the longitudinal cutter unit and the transverse cutter unit, the former may not be required. In this case, the spiral angle of the rotary cutter is preferably 5 to 30 in order to cut the documents into longitudinal slips.

Although the present invention has been fully described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims unless they depart therefrom.

What is claimed is:

1. A shredding machine comprises:

a rotary cutter including a cutter part with a spiral cutting edge and a column part, the cutter part and the column part being of a unitary construction;

a fixed cutter arranged to contact with the cutter part of said rotary cutter;

rotary cutter holding means for rotatably holding at least the column part of said rotary cutter for rotation of said rotary cutter, wherein said fixed cutter is made of a relatively softer material than said rotary cutter;

means for biasing said fixed cutter against said rotary cutter; and means for continuously rotating the rotary cutter in one direction.

2. The shredding machine as claimed in claim 1, further comprising a second rotary cutter holding means for rotatably holding one end of the cutter part of said rotary cutter for rotation of said rotary cutter, the one end thereof being opposite to the other end thereof connected to the column part.

3. The shredding machine as claimed in claim 1, wherein each column part of said rotary cutter is arranged at each end of the cutter part and is rotatably held by said holding means.

4. The shredding machine as claimed in claim 1, further comprising:

a fixed cutter holding means for pivotably supporting one end of said fixed cutter.

5. The shredding machine as claimed in claim 1, wherein said fixed cutter is so arranged that one face of said fixed cutter is positioned in a direction substantially perpendicularly intersecting a direction in which said rotary cutter moves, said machine further comprising a document transporting means for transporting documents to the one face of said fixed cutter.

6. The shredding machine as claimed in claim 5, further comprising a guide means for guiding the documents transported by said transporting means to the one face of said fixed cutter.

7. The shredding machine as claimed in claim 5, wherein said transporting means comprises a pair of cutter members for cutting the documents to form slips, each cutter member having a shaft, plural circular cutting edges fixed on the shaft, and plural spacers, each spacer being arranged between the adjacent circular cutting edges and having an opening for rotation of the shaft, whereby the slips are shredded into chips by said rotary cutter and said fixed cutter, wherein the slips are received at the rotary cutter in an orientation transverse to said transporting means and wherein said rotary cutter includes two column parts at opposing ends of the rotary cutter and said rotary cutter holding means further detachably holds at least one of the two column parts for rotation of the rotary cutter.

8. A shredding machine comprising:

a one-piece rotary cutter including a cutter part with a spiral cutting edge formed on both sides of a flute and two column parts, each of the two column parts being integrally formed at each end of the cutter part, said rotary cutter being continuously rotatable in a single direction for shredding;

a fixed cutter arranged to contact with the cutter part of said rotary cutter;

rotary cutter holding means for rotatably and detachably holding at least the column part of said rotary cutter for rotation of the same; and means for biasing said fixed cutter against said rotary cutter, wherein said fixed cutter is made of a relatively softer material than said rotary cutter.

9. The shredding machine as claimed in claim 8, further comprising a second rotary cutter holding means for rotatably holding one end of the cutter part of said rotary cutter for rotation of said rotary cutter, the one end thereof being opposite to the other end thereof connected to the column part.

10. The shredding machine as claimed in claim 8, wherein each column pat of said rotary cutter is arranged at each end of the cutter part and is rotatably held by said holding means.

11. The shredding machine as claimed in claim 8, further comprising a fixed cutter holding means for pivotably supporting one end of said fixed cutter.

12. The shredding machine as claimed in claim 8, wherein said fixed cutter is so arranged that one face of said fixed cutter is positioned in a direction substantially perpendicularly intersecting a direction in which said rotary cutter moves, said machine further comprising a document transporting means for transporting documents to the one face of said fixed cutter.

13. The shredding machine as claimed in claim 12, wherein said transporting means comprising a pair of cutter members for cutting the documents to form slips, each cutter member having a shaft, plural circular cutting edges fixed on the shaft, and plural spacers, each spacer being arranged between the adjacent circular cutting edges and having an opening for rotation of the shaft, whereby the slips are shredded into chips by positioning the slips transverse to said transporting means by said rotary cutter and said fixed cutter, and wherein said rotary cutter includes two column parts at opposing ends of the rotary cutter and said rotary cutter holding means further detachably holds at least one of the two column parts for rotation of the rotary cutter.

14. A shredding machine comprising:

a rotary cutter including a cutter part with a spiral cutting edge and a column part, the cutter part and column part being of a one-piece construction;

a fixed cutter arranged to contact with the cutter part of said rotary cutter, said fixed cutter being made of thin folded sheet metal, one folded end of said fixed cutter contacting with said rotary cutter by a bias means for pressing said fixed cutter against said rotary cutter; and rotary cutter holding means for rotatably holding at least the column part of said rotary cutter, wherein said fixed cutter is made of a relatively softer material than said rotary cutter.

* * * * *